United States Patent [19]

Kosmatka et al.

[11] Patent Number: 4,463,278

[45] Date of Patent: Jul. 31, 1984

[54] LAMP UNIT HAVING ACCURATELY POSITIONED FILAMENT

[75] Inventors: Walter J. Kosmatka, South Euclid; Frank E. Zalar, Euclid, both of Ohio

[73] Assignee: General Electric Company, Schenectady, N.Y.

[21] Appl. No.: 380,482

[22] Filed: May 21, 1982

[51] Int. Cl.[3] ..... H01J 5/48; H01J 5/50

[52] U.S. Cl. ..... 313/318; 313/315; 339/145 R; 339/154 L

[58] Field of Search ..... 313/315, 318; 339/145 R, 154 L, 155 L, 206 L

[56] References Cited

U.S. PATENT DOCUMENTS

| | | | |
|---|---|---|---|
| 3,262,001 | 7/1966 | Rijckeart | 313/318 |
| 4,013,335 | 3/1977 | Jarkonyi et al. | 313/318 |
| 4,254,358 | 3/1981 | Saito | 313/318 |
| 4,310,772 | 1/1982 | Tyler et al. | 313/318 |
| 4,358,708 | 11/1982 | Silva et al. | 313/318 |
| 4,384,236 | 5/1983 | Hellwig et al. | 313/315 |

*Primary Examiner*—Saxfield Chatmon

*Attorney, Agent, or Firm*—John F. McDevitt; Philip L. Schlamp; Fred Jacob

[57] ABSTRACT

A light bulb is held by a base to which the bulb is secured after being adjusted longitudinally, laterally, and rotationally, as needed, to accurately position the bulb's filament with respect to the base. No cement or adhesive is in contact with the light bulb.

7 Claims, 5 Drawing Figures

Fig. 1
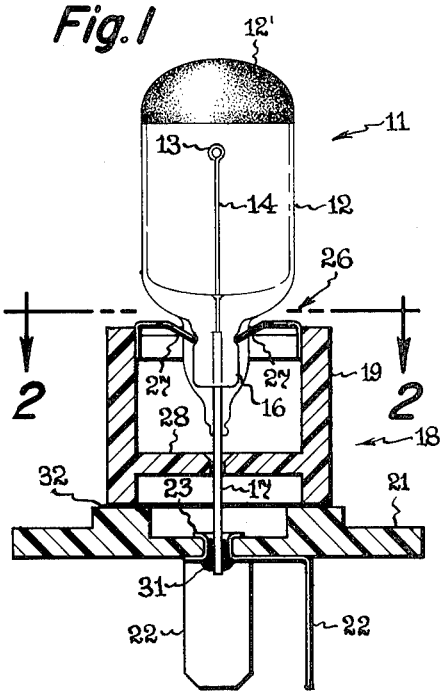
Fig. 3
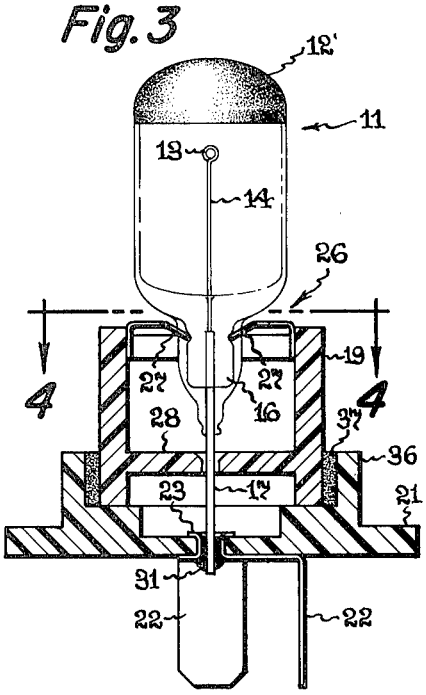
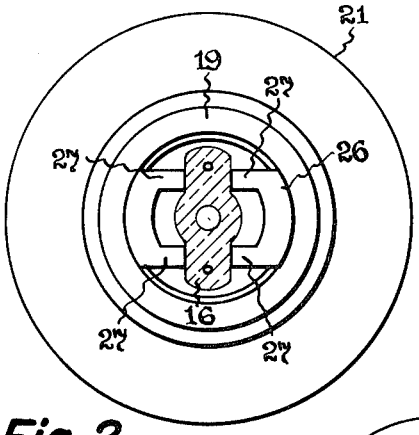
Fig. 2
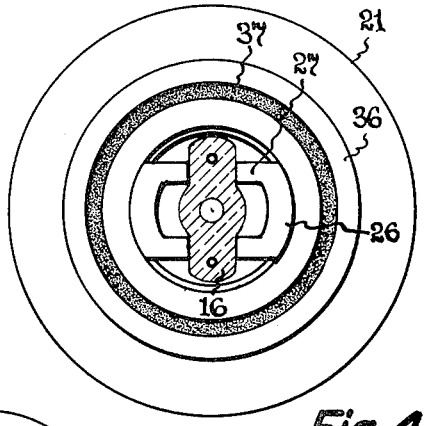
Fig. 4
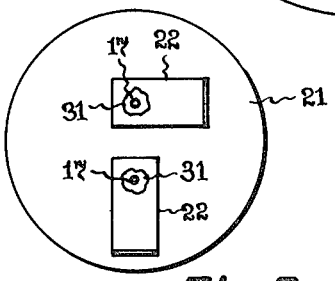
Fig. 5

LAMP UNIT HAVING ACCURATELY POSITIONED FILAMENT

CROSS-REFERENCE TO RELATED APPLICATION

Ser. No. 380,483, filed concurrently herewith, Kosmatka and Zalar, "Lamp Unit Having Accurately Positioned Filament", assigned the same as this invention.

BACKGROUND OF THE INVENTION

The invention is in the field of based light bulbs having one or more filaments accurately positioned with respect to the base.

Light bulbs for certain uses require accurate positioning and alignment of their filament (or filaments) with respect to the base. For example, replaceable light bulbs for reflector lamps such as automobile headlamps are attached at their bases to the reflector, and the bulb's filament (or filaments) must be accurately positioned or centered at or with respect to the focal point of the reflector in order that the intended light beam pattern will be produced. Certain slide and movie projectors are further examples of optical equipment requiring accurate positioning of a lamp's filament with respect to its base.

Several ways have been devised for accurately positioning a light bulb's filament (or filaments) with respect to its base. For example, U.S. Pat. No. 3,885,149 to Wolfe discloses a prefocus lamp having a light bulb secured to a capping box which is held by a cup which is held by a cylindrical sleeve to which a focusing collar is attached in accurate alignment with the filament. U.S. Pat. No. 3,469,140 to Bottone discloses a light bulb cemented into a base and adjusted to align the filament with respect to the base while the cement is soft, and held in this position until the cement hardens. U.S. Pat. Nos. 3,904,909 and 3,960,278 to Vause disclose a lamp having metal brackets partially embedded in the bulb's pinch seal and in accurate alignment with the bulb's filament.

These prior base arrangements have various undesirable characteristics such as an expensive complexity of parts and/or requiring cement or metal parts adhered to the light bulb which, due to the high temperature when the lamp is operating (especially for halide lamps), can cause the bulb to crack. The range of choice for metals and cement adhesives in contact with the bulb is thus undesirably limited to those having thermal expansion coefficients similar to that of the bulb, and the adhesives are further limited to some generally expensive high-temperature types that usually require a relatively long time to harden, thus increasing the manufacturing cost.

SUMMARY OF THE INVENTION

Objects of the invention are to provide a simplified and inexpensive construction of a based prefocused light bulb and which does not require cement or any other material adhered to the bulb.

The invention comprises, briefly and in a preferred embodiment, a light bulb secured to a base, the base having a tubular lamp holder member attached at an end thereof to a bottom member having terminals for the lamp's lead-in wires, the lead-in wires being longitudinally slidable in the terminals prior to securing thereto, and the holder member being slidable laterally on the bottom member prior to securing thereto, whereby the filament of the lamp is accurately positioned with respect to the bottom member which functions as a means for attaching the lamp to a reflector or other device.

BRIEF DESCRIPTION OF THE DRAWINGS

FIG. 1 is a side view of a preferred embodiment of the invention, the light bulb being shown in a side view and its base being shown in a cross-sectional view.

FIG. 2 is a view looking down on the line 2—2 of FIG. 1.

FIG. 3 is a side view of an alternative preferred embodiment, the light bulb being shown in a side view and its base being shown in a cross-sectional view.

FIG. 4 is a view looking down on the line 4—4 of FIG. 3.

FIG. 5 is a bottom view of both FIGS. 1 and 3.

DESCRIPTION OF THE PREFERRED EMBODIMENTS

In FIG. 1, a light bulb 11, which may be an incandescent or arc type, and also may be a halogen gas type, has a bulb or envelope 12 which may be of suitable material such as glass or quartz. The bulb 12 contains a light source 13 shown as an incandescent-type filament (shown in end view) supported by a pair of inlead wires 14 held by a pinch seal region 16 of the bulb 12. Conventionally, molybdenum metal strips are hermetically sealed to the bulb material in the pinch seal 16, an end of each strip being respectively welded to the inlead wires 14, and the other end of each strip being respectively welded to a pair of lead-in wires 17 extending in a mutually parallel relationship exteriorly of the bulb 12. Two or more filaments 13 may be provided, such as hi-and-lo light beam filaments in an automobile headlight bulb, in which case there will be three or more inlead wires 14 and lead-in wires 17. Alternatively, the light source 13 may be an arc discharge. The end 12' of the bulb 12 may be blackened or coated to reduce glare.

The base 18 comprises a hollow lamp holder member 19, preferably cylindrical and of plastic material, and rested on and secured to a flat surface of a bottom member 21, which may be disc-shaped and of plastic material. A plurality of terminals 22, which can be metal strips bent at right angles as shown, are attached to the bottom member 21 such as by means of integral eyelets 23 extending through and peened over openings in the member 21 in alignment with the lead-in wires 17, which lead-in wires respectively pass into or through the eyelets 23. A metal lamp-aligning washer or disc clip 26 fits slidably within the holder member 19 and is provided with fingers 27 which resiliently engage against and hold the pinch seal 16. Thus the lamp bulb 11 and clip 26 are longitudinally slidable in the holder 19, with the lead-in wires 17 being slidable in or through the terminal eyelets 23, until the lead-in wires 17 are attached to the eyelets 23 or terminals 22, as will be described. A rib 28 may be provided within the holder 19 to aid in positioning and guiding the lead-in wires 17. The bottom member 21 may be configured to clip on or in or attach to a mounting such as an opening of a reflector, and may be a twist-in type as disclosed in U.S. Pat. No. 4,019,045 to Bassett.

The light bulb is quickly, easily, and economically secured to the base 18 so that the light source 13 is accurately aligned and positioned with respect to the unit's attachment member 21, as follows. Using visual or other suitable means, such as eyesight, measuring apparatus, an optical projection screen, or placing the lamp in a reflector and lighting the filament and observing or measuring the reflected projected light beam pattern, the bulb 11 and slider disc 26 are moved longitudinally to the desired correct longitudinal positioning of the light source 13 with respect to the bottom base portion 21, and the lamp holder 19 is moved laterally on the bottom member 21 to the correct lateral positioning of the light source 13 (causing the lead-in wires 17 to tilt or bend slightly) and then the lead-in wires 17 are soldered 31 or otherwise attached to the eyelets 23 or the terminals 22, and the holder 19 is attached to the bottom member 21 by cement or other adhesive 32 or by ultrasonic welding, or by mechanical fasteners such as screws or rivets. If an adhesive is used, it can be applied between the members 19 and 21 prior to their lateral relative positioning, whereupon it hardens naturally or with the application of heat or a curing agent while the parts are maintained in correct position. The invention permits a further adjustment, if needed: the lamp 11 and its holder 19 can be rotated slightly on the bottom member 21, prior to attachment thereto, to provide proper orientation of the filament 13 on a desired axis with respect to the bottom member 21. This will slightly twist the lead-in wires 17 with respect to one another, which will not affect performance. The end result is a lamp unit with its light source 13 accurately positioned with respect to the mounting base part 21. Both the longitudinal and lateral positioning of the bulb 11 in the base 18 generally are no greater than about 1/16 inch from the norm.

The invention achieves accurate positioning of the bulb's light source (or sources) 13 with respect to the base's mounting and positioning member 21 without requiring any cement or other adhesive or any other material adhered or sealed to the lamp's bulb 12 or its press seal 16, thus obviating the prior art problems of attempting to match coefficients of expansion of the adjoining materials with the attendant problem of bulb cracking. Also, if an adhesive is used to join the holder 19 and bottom member 21, it can include a wide variety of low-temperature and inexpensive types. In lieu of the metal terminals 22, the lead-in wires 17 can be adhesively adhered to the member 21 and protrude therefrom to provide the connection terminals. The lamp unit is impervious to dirt and moisture through the base, and the light bulb is vibration-resistant with respect to the base, even though no cement is in contact with the bulb.

The embodiment of FIGS. 3 and 4 is similar to that of FIGS. 1 and 2, except that the bottom member 21 is provided with a raised shoulder 36 surrounding and spaced from the lamp holder 19, with cement or other adhesive 37 such as an inexpensive foaming polymetric compound cylindrically between these members and which hardens after the holder 19 is laterally positioned on the bottom member 21 to accurately position the light source 13 with respect to the bottom mounting member 21.

While preferred embodiments and modifications of the invention have been shown and described, various other embodiments and modifications thereof will become apparent to persons skilled in the art and will fall within the scope of the invention as defined in the following claims.

What we claim as new and desire to secure by Letters Patent of the United States is:

1. A lamp unit comprising a light bulb secured to a base, said light bulb comprising a sealed envelope with a pinch seal enclosing a light source and having lead-in wires extending externally of the envelope, and said base comprising a tubular lamp holder member having an end thereof positioned against a flat surface of a bottom member, said tubular lamp holder member being provided with lamp alignment and support means slidable in the lamp holder member and frictionally engaging the light bulb for alignment with respect to said lamp holder member, said bottom member being provided with openings for receiving said lead-in wires of the light bulb, said light bulb being positioned to extend at least partly into said tubular lamp holder member with its lead-in wires extending into or through said openings, means attaching said lead-in wires to said bottom member, and means attaching said tubular lamp holder member to said bottom member, whereby prior to said attachments said light bulb is longitudinally movable in said base, and said light bulb and tubular lamp holder member are laterally and rotatably movable with respect to said bottom member, thereby permitting accurate alignment of said light source with respect to said bottom member.

2. A lamp unit as claimed in claim 1, in which said light bulb comprises a pinch seal, and in which said lamp alignment and support means is provided with fingers resiliently in engagement against said pinch seal.

3. A lamp unit as claimed in claim 1, in which said tubular lamp holder member and said bottom member have circular cross-sections.

4. A lamp unit as claimed in claim 1, in which said bottom member is provided with terminals attached thereto by integral eyelets extending through said openings, said lead-in wires of the lamp extending into said eyelets.

5. A lamp unit as claimed in claim 4, in which said lead-in wires are soldered to said eyelets.

6. A lamp unit as claimed in claim 1, in which said tubular lamp holder member is adhesively attached to said bottom member.

7. A lamp unit as claimed in claim 1, in which said bottom member is provided with a raised shoulder surrounding and spaced from said tubular lamp holder member, said members being attached together by adhesive material positioned between said shoulder and said tubular lamp holder member.

* * * * *